United States Patent [19]

Gordon et al.

[11] Patent Number: 5,022,594

[45] Date of Patent: Jun. 11, 1991

[54] MINCER KNIFE HEAD

[76] Inventors: Anatoly M. Gordon, ulitsa Kirova, 8, kv. 29, Voronezh, U.S.S.R.; Eduard L. Fedorov, ulitsa Ju. Yanonisa, II, kv. 9, Voronezh, U.S.S.R.; Anatoly F. Grachev, Moskovsky prospekt, 56, kv. 39, Voronezh, U.S.S.R.

[21] Appl. No.: 460,904

[22] PCT Filed: Jun. 15, 1989

[86] PCT No.: PCT/SU89/00159

§ 371 Date: Feb. 16, 1990

§ 102(e) Date: Feb. 16, 1990

[87] PCT Pub. No.: WO89/12503

PCT Pub. Date: Dec. 28, 1989

[30] Foreign Application Priority Data

Jun. 21, 1988 [SU] U.S.S.R. ..... 4445404
Jun. 22, 1988 [SU] U.S.S.R. ..... 4447159

[51] Int. Cl.[5] ..... B02C 18/16

[52] U.S. Cl. ..... 241/282.2; 241/292; 241/292.1

[58] Field of Search ..... 241/282.1, 282.2, 292, 241/292.1

[56] References Cited

U.S. PATENT DOCUMENTS 4,294,415 10/1981 Wetter et al. ..... 241/292
4,407,458 10/1983 Hotimsky ..... 241/292 X
4,770,353 9/1988 Steffens ..... 241/292 X

FOREIGN PATENT DOCUMENTS 2522859 1/1979 Fed. Rep. of Germany .
957959 10/1982 U.S.S.R. .
967450 6/1986 U.S.S.R. .

*Primary Examiner*—Timothy V. Eley
*Attorney, Agent, or Firm*—Ladas & Parry

[57] ABSTRACT

A mincer knife head comprises a shaft 1 carrying, consecutively arranged thereon, a support bushing 4, a group of main bushings (6, 7, 8), and a fixing member (27). Each main bushing (6, 7, 8) is mechanically associated with an appropriate knife (9, 10, 11) and each carries four balancing disks (12, 13, 14, 15; 16, 17, 18, 19; 20, 21, 22, 23), each made in the form of an eccentric.

7 Claims, 8 Drawing Sheets

MINCER KNIFE HEAD

TECHNICAL FIELD

The present invention relates to meat and meat products grinding arrangements, and more precisely to mincer knife heads.

PRIOR ART

The higher demands made on the meat and food industries, specifically the need to expand the range of meat products, have given rise to more stringent requirements placed upon the design of mincers, particularly on their knife heads.

Known in the art is a mincer knife head (cf., V. I. Ivanov et al. "New Cutting Devices for Mincers". A Review. "Mincer Knife and Knife Heads", p. 18. Moscow, 1986), comprising a shaft carrying, consecutively arranged thereon, a support bushing, a group of main bushings, each mechanically associated with at least one knife and carrying at least one balancing disk, and a fixing member. A minimum of three holes, equidistant from each other, are provided on the periphery of each balancing disk incoporated in said knife head, and the latter additionally contains groups of pins with the number thereof equal to that of the balancing disks, the number of pins in each group being inferior to the number of the holes in the appropriate balancing disk.

However, the pins allow only discrete balancing of said knife head to be performed, which affects balancing accuracy.

Moreover, the indispensable displacement of the pins in the holes of the balancing disks results in quick destruction thereof, which is conducive to a shorter service life of the knife head.

Furthermore, the presence of pins in said knife head involves a higher metal consumption.

Also, the constant radius of the knife rotation about the axis of the shaft does not allow the knife overhang to be adjusted, which affects operational reliability of the knife head.

DISCLOSURE OF THE INVENTION

The invention is aimed at providing a mincer knife head whose balancing disks would permit continuous balancing, their shape would make it possible to extend their service life and cut down metal consumption, and rotation of the knives would allow adjustment of the overhang.

This is accomplished by that in a mincer knife head comprising a shaft carrying, consecutively arranged thereon, a support bushing, a group of main bushings, each mechanically associated with at least one knife and carrying at least one balancing disk, and a fixing member, according to the invention, the balancing disks are made in the form of eccentries.

It is expedient that in a mincer knife head with a plurality of balancing disks the latter have different thickness and eccentricity.

It is desirable that each main bushing be made in the form of an eccentric.

It is reasonable that each main bushing in a mincer knife head with two knives be two-stepped, with the eccentricities of the steps facing opposite directions, and each carrying an appropriate knife.

It is also expedient that a mincer knife head include additional bushings with the number thereof equal to that of the main bushings, made in the form of eccentrics, fitted on the shaft before each appropriate main bushing, and each carrying an appropriate knife.

It is also desirable that in said knife head external surfaces of the main bushings and internal surfaces of the knives and the balancing disks have teeth with the identical module thereof and a reference point.

It is also reasonable that in a mincer knife head external surfaces of the additional bushings and the internal surfaces of the knives have teeth with the identical module thereof and a reference point.

The present invention permits continuous balancing, which adds to the accuracy of balancing the mincer knife head.

Besides, the present invention makes it possible to extend the service life of the balancing disks and, consequently, that of the mincer knife head.

Furthermore, the present invention permits of cutting down the consumption of metal for the balancing disks and, accordingly, for the mincer knife head.

Also, the present invention enables the knives to revolve with a variable rotation radius, which allows the overhang of the knives to be adjusted and, accordingly, operational reliability of the mincer knife head to be enhanced.

BRIEF DESCRIPTION OF THE DRAWINGS

The invention will now be explained with reference to specific embodiments thereof taken in conjunction with the accompanying drawings, wherein.

BEST MODE FOR CARRYING OUT THE INVENTION

Figure 2:
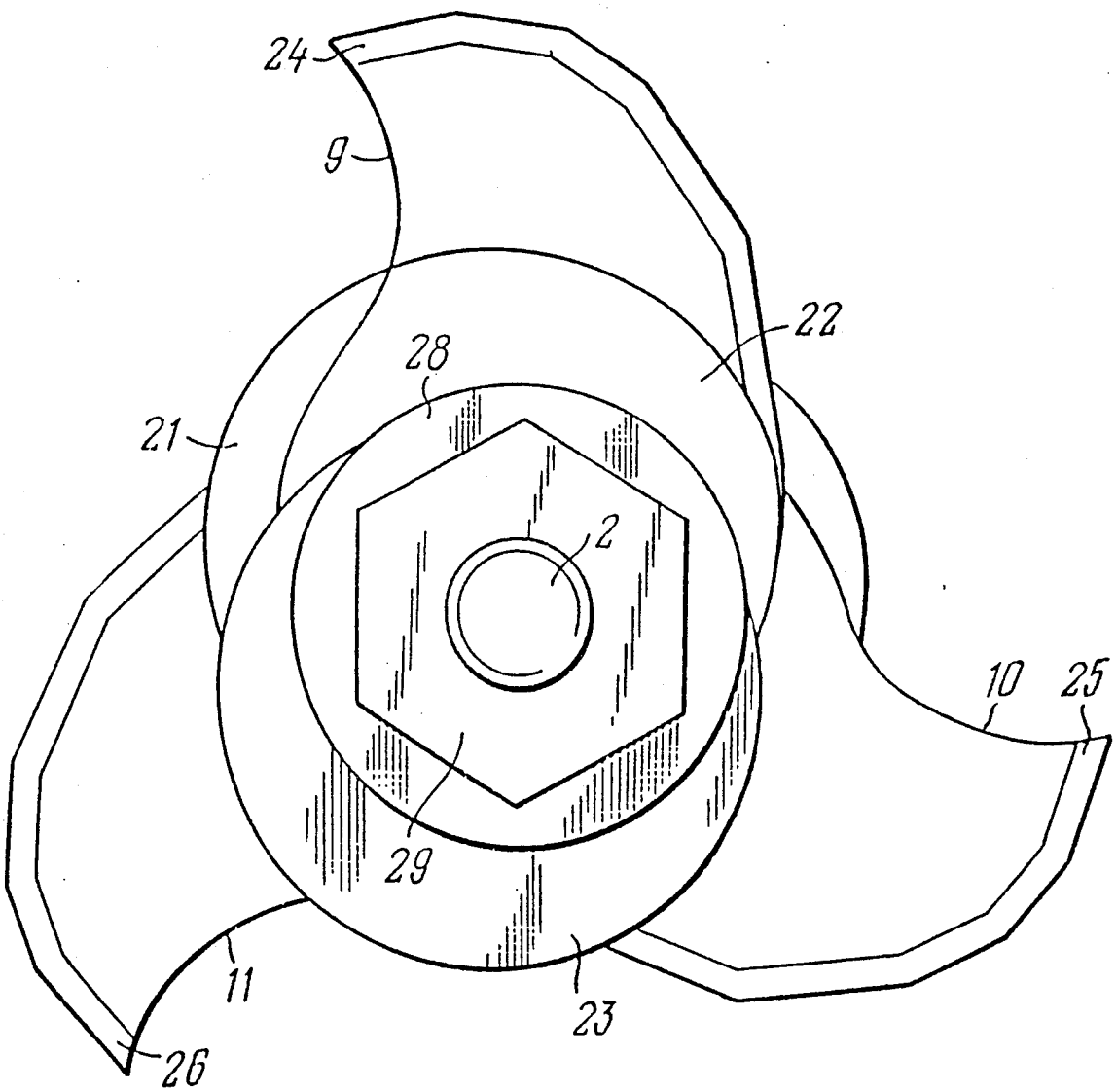
FIG. 2 is a view along arrow A in FIG. 1.
Figure 3:
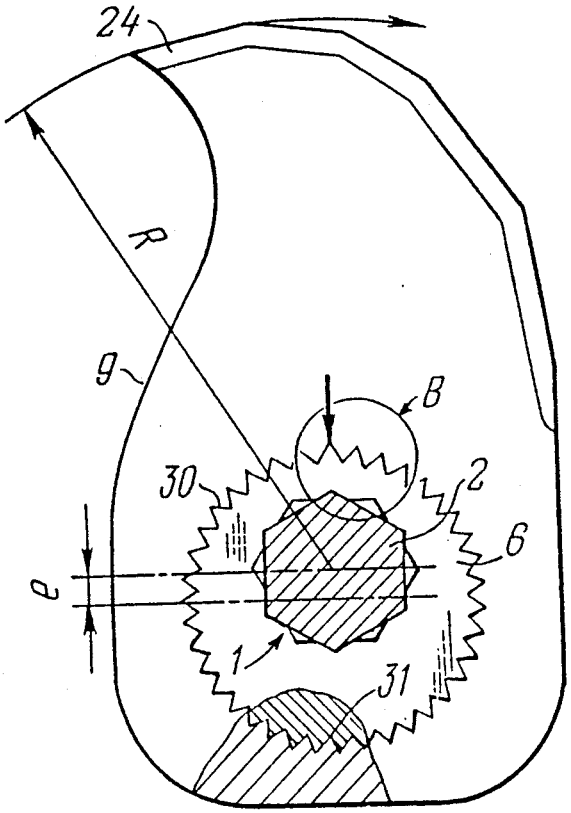
FIG. 3 is a cross-sectional view taken along line III—III in FIG. 1.
Figure 4:
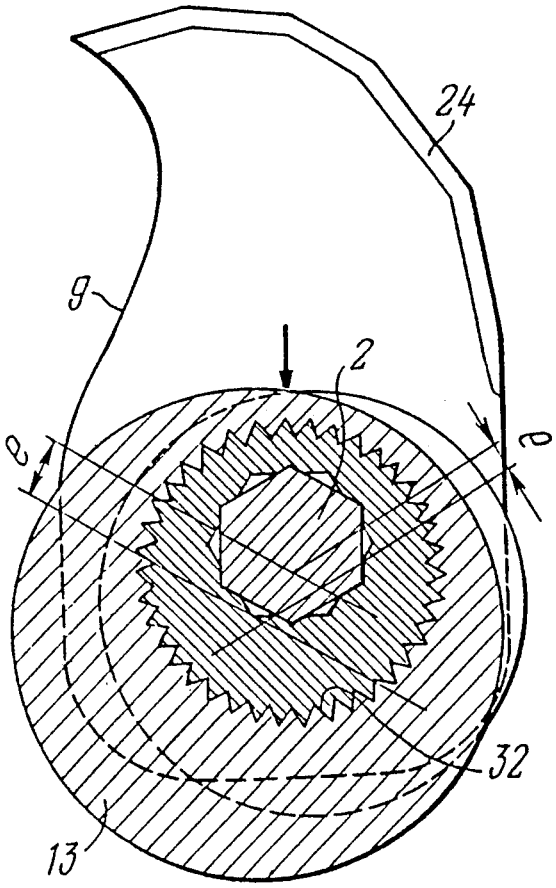
FIG. 4 is a cross-sectional view taken along line IV—IV in FIG. 1.
Figure 5:
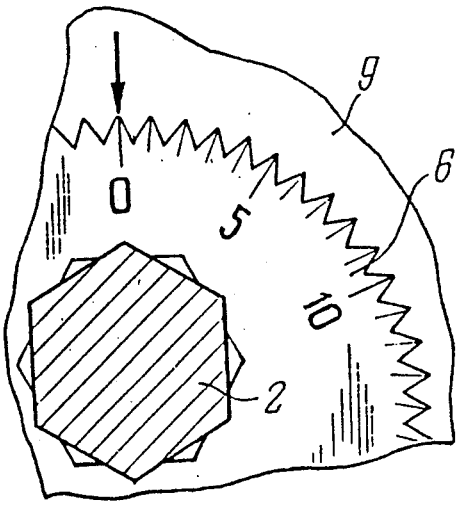
FIG. 5 is unit B in FIG. 3 (enlarged)

A mincer knife head comprises a two-stepped shaft 1 (FIG. 1), whose one step 2 with a smaller diameter is hexahedral and another step 3 with a larger diameter is cylindrical. The step 2 carries a support bushing 4 contacting an end face 5 of the step 3 and three main bushings 6, 7, 8, each made in the form of an eccentric (hereinafter termed eccentric main bushing 6, 7, 8 for clarity). Each bushing 6, 7, 8 carries, one after another, knives 9, 10, 11 respectively and four balancing disks 12, 13, 14, 15 (on the bushing 6), 16, 17, 18, 19 (on the bushing 7) and 20, 21, 22, 23 (on the bushing 8). The balancing disks 12, 13, 14, 15, 16, 17, 18, 19, 20, 21, 22, 23 are of different thickness and made in the form of eccentrics (hereinafter termed eccentric disks 12, 13, 14, 15, 16, 17, 18, 19, 20, 21, 22, 23 for clarity). Cutting edges 24, 25, 26 (FIGS. 1, 2) of the knives 9, 10, 11 are arranged at an equal angle relative to one another. Located on the shaft 1 after the bushing 8 is a fixing member 27, including a washer 28 and a nut 29, arranged one after another. External surfaces 30 (FIG. 3) of the main bushings 6, 7, 8, internal surfaces 31 of the knives 9, 10, 11 (FIG. 1) and internal surfaces 32 (FIG. 4) of the balancing disks 12, 13, 14, 15, 16, 17, 18, 19, 20, 21, 22, 23 (FIG. 1) have teeth with the identical module and a reference point marked by digit "0" for the bushings 6, 7, 8 (FIG. 5) and by an arrow " ↓ " for the knives 9, 10, 11.

Figure 1:
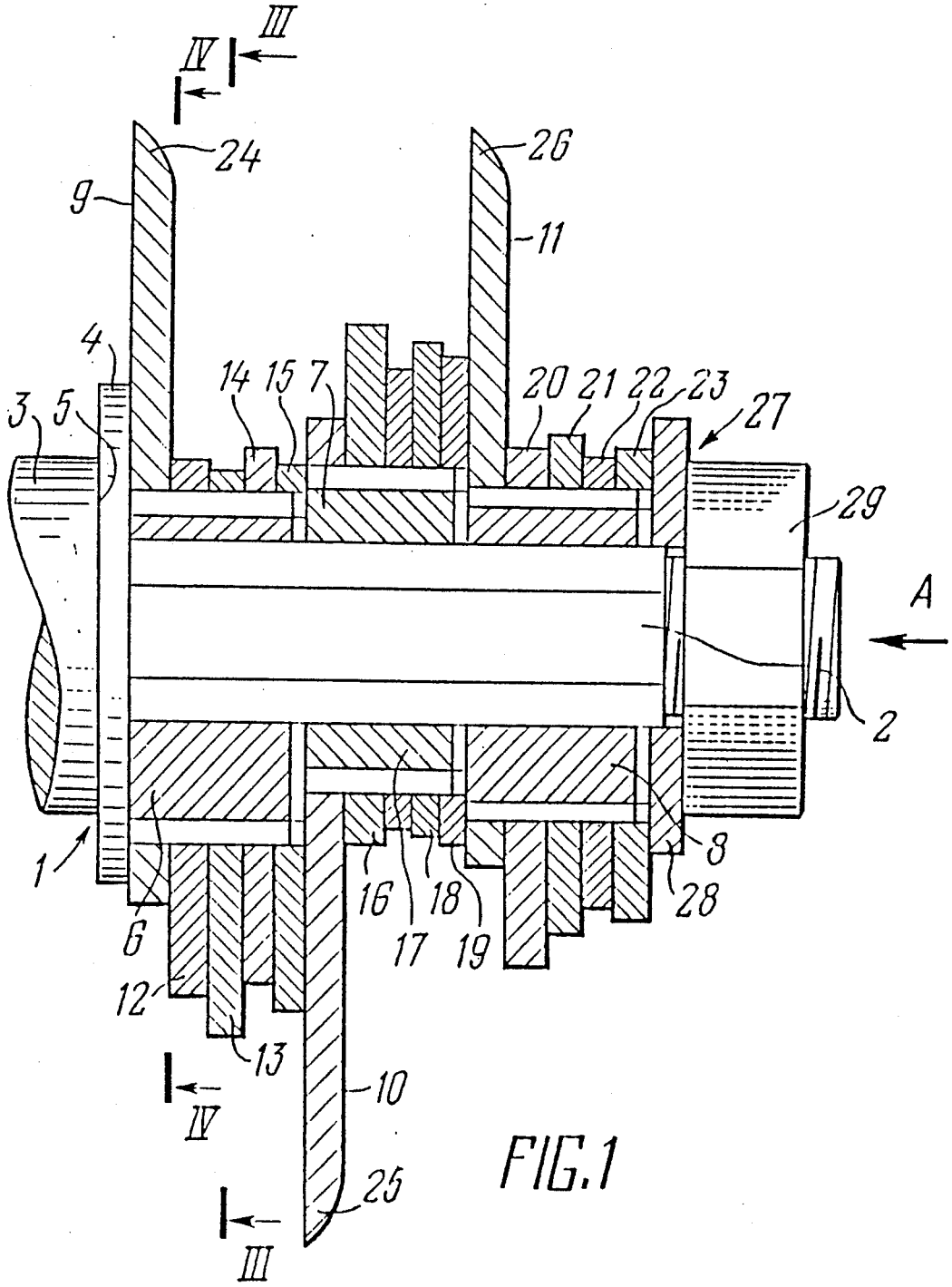
FIG. 1 is a general view of a mincer knife head (longitudinal section), according to the invention.
Figure 6:
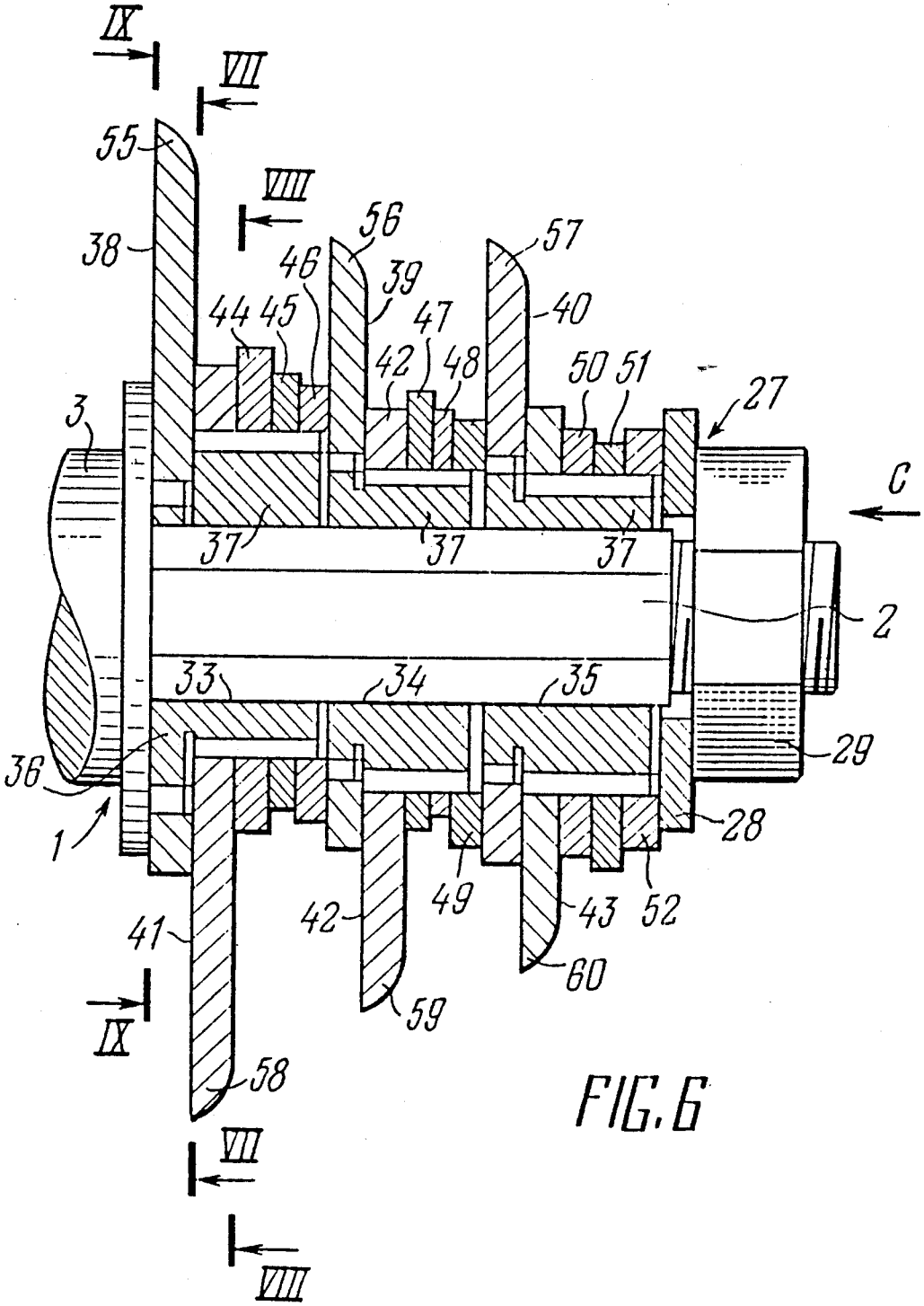
FIG. 6 is a general view of a mincer knife head in FIG. 1 with two-stepped main bushings (longitudinal section), according to the invention.
Figure 7:
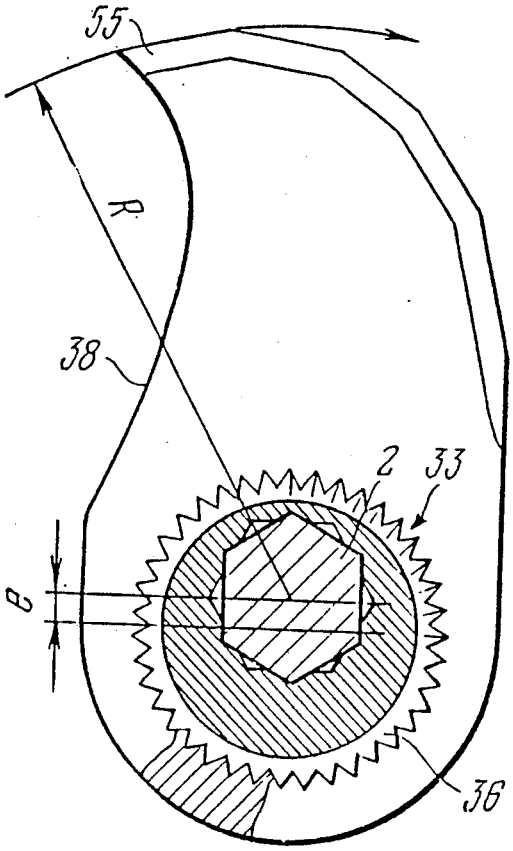
FIG. 7 is a cross-sectional view taken along line VII—VII in FIG. 6.
Figure 8:
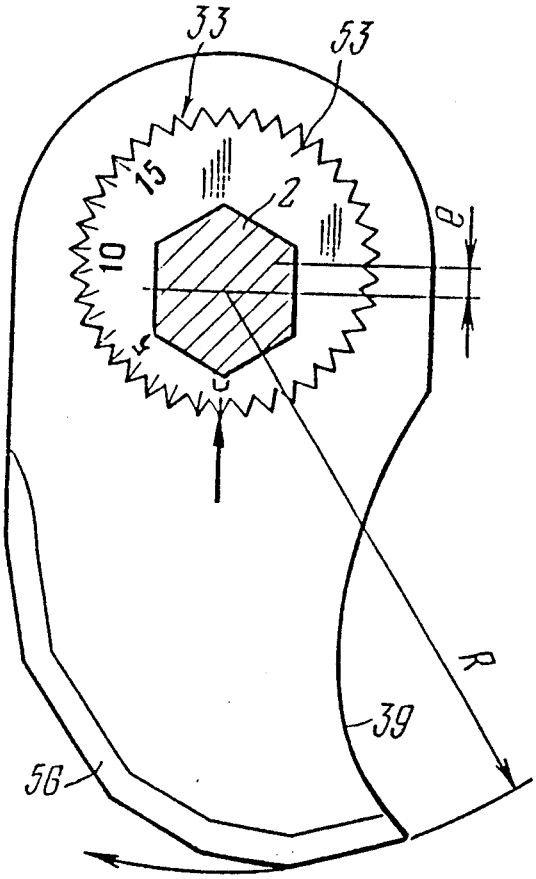
FIG. 8 is a cross-sectional view taken along line VIII—VIII in FIG. 6.

In accordance with another embodiment of the invention, the design of a mincer knife head is similar to that described with reference to FIG. 1, except that main bushings 33, 34, 35 (FIG. 6) are two-stepped, each step 36, 37 having an eccentricity "e". The eccentricities "e" of the steops 36 (FIG. 7) and 37 (FIG. 8) in each bushing 33, 34, 35 are facing the opposite directions. The step 36 of each bushing 33, 34, 35 carries one pair of knives 38, 39, 40 (FIG. 6). The step 37 carries another pair of knives 41, 42, 43 and three balancing disks 44, 45, 46 (on the bushing 33), 47, 48, 49 (on the bushing 34) and 50, 51, 52 (on the bushing 35), made in the form of eccentrics (hereinafter termed eccentric disks 44, 45, 46, 47, 48, 49, 50, 51, 52 for clarity).

Figure 9:
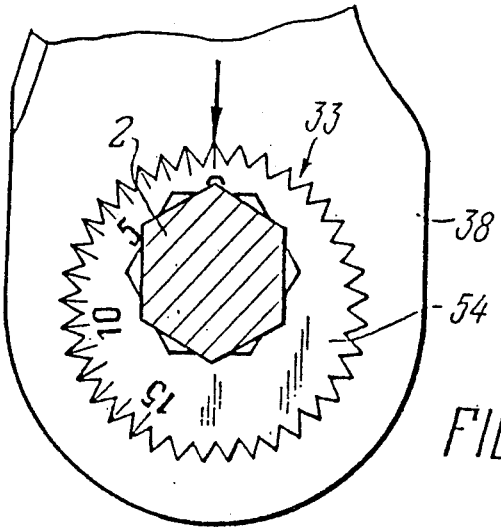
FIG. 9 is a cross-sectional view taken along line IX—IX in FIG. 6.
Figure 10:
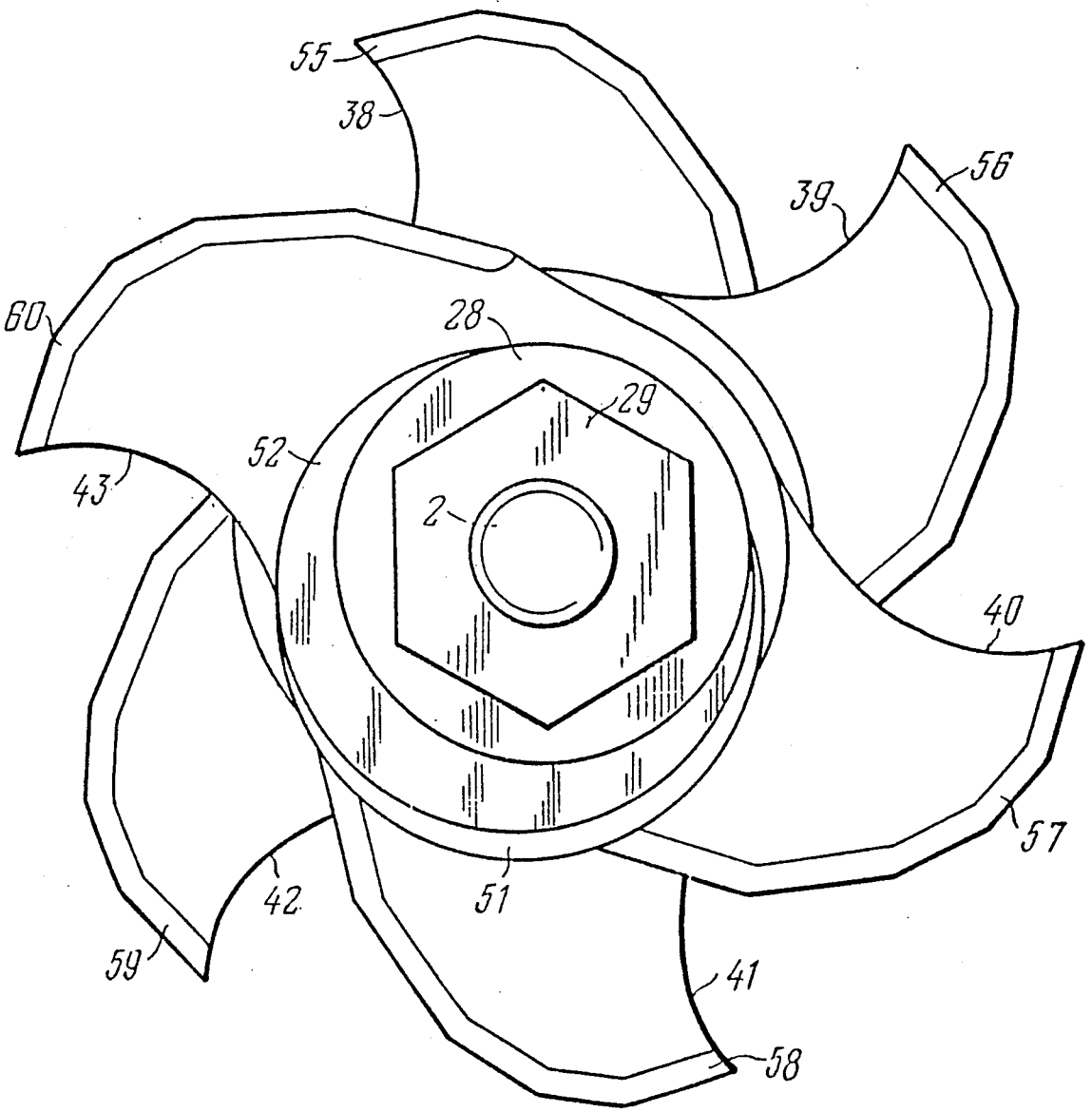
FIG. 10 is a view along arrow C in FIG. 6.

End faces 53 (FIG. 8) and 54 (FIG. 9) of the bushings 33, 34, 35 (FIG. 6) show initial reference points marked by the digit "0" and by the arrow " ↓ " in the event of the knives 38, 39, 40, 41, 42, 43 (FIG. 6), as described hereinabove. Cutting edges 55, 56, 57, 58, 59, 60 of the knives 38, 39, 40, 41, 42, 43 (FIG. 10) are at an equal angle relative to each other.

Figure 11:
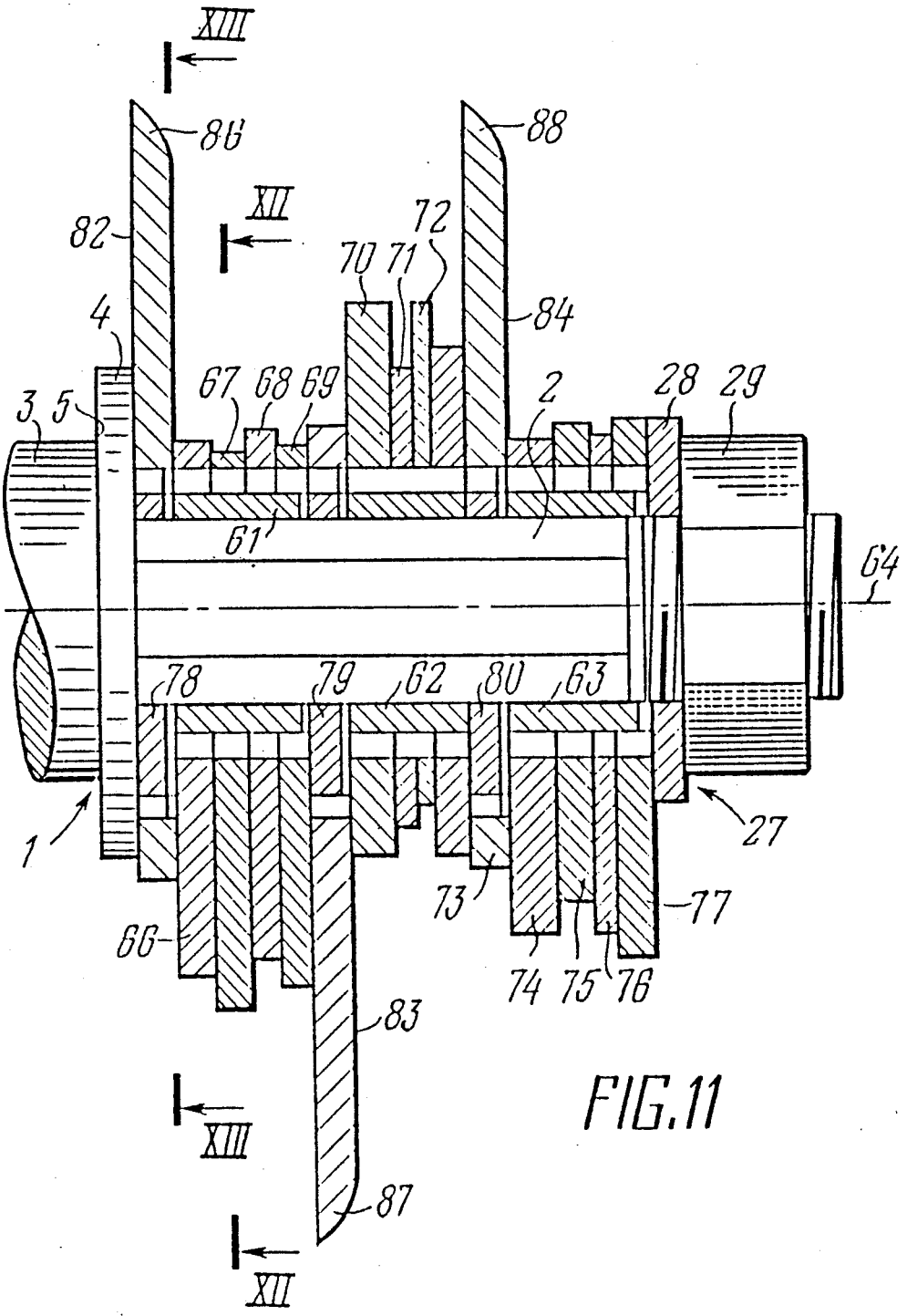
FIG. 11 is a general view of a mincer knife head in FIG. 1 with additional bushings (longitudinal section), according to the invention.
Figure 12:
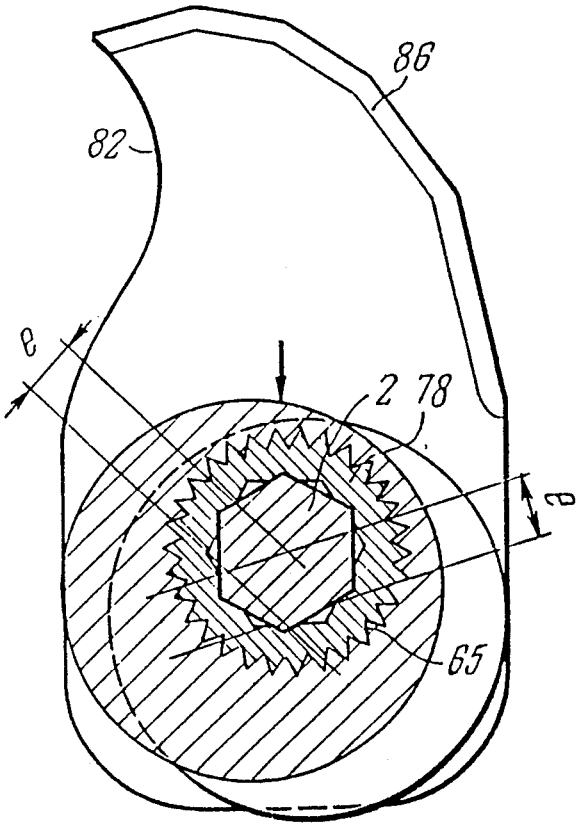
FIG. 12 is a cross-sectional view taken along line XII—XII in FIG. 11.

In accordance with yet another embodiment of the invention, the design of a mincer knife head is similar to that described with reference to FIG. 1, except that longitudinal axes of main bushings 61, 62, 63 (FIG. 11) coincide with a longitudinal axis 64 of the shaft 1 and each of them has a toothed surface 65 (FIG. 12). Each bushing 61, 62, 63 (FIG. 11) carries four balancing disks 66, 67, 68, 69 (on the bushing 61), 70, 71, 72, 73 (on the bushing 62) and 74, 75, 76, 77 (on the bushing 63), and each has a toothed internal surface (no reference numeral). The balancing disks 66, 67, 68, 69, 70, 71, 72, 73, 74, 75, 76, 77 (FIG. 11) are shaped as eccentrics (hereinafter termed eccentric disks 66, 67, 68, 69, 70, 71, 72, 73, 74, 75, 76, 77 for clarity). The shaft 1 carries, before each main bushing 61, 62, 63, additional bushings 78, 79, 80, each shaped as eccentric (hereinafter termed additional eccentric bushings 78, 79, 80 for clarity). External surfaces 81 (FIG. 13) of the bushings 78, 79, 80 are toothed. Each bushing 78, 79, 80 (FIG. 11) carries knives 82, 83, 84 respectively, whose internal surfaces 85 (FIG. 13) have teeth with the module identical with that of the toothed surface 8 of the bushings 78, 79, 80. The reference point for the bushings 78, 79, 80 is designated by the digit "0", and for the knives 82, 83, 84 by the arrow " ↓ ". Cutting edges 86 (FIGS. 11, 12, 13), 87, 88 (FIG. 11) of the knives 82, 83, 84 (FIG. 11) are disposed in a manner similar to that described with reference to FIGS. 1, 2.

Assembly of a mincer knife head shown in FIGS. 1, 2, 3, 4, 5 is performed in the following sequence.

Initially, each main bushing 6, 7, 8 is balanced jointly with the respective knives 9, 10, 11 and four eccentric disks 12, 13, 14, 15 (for the bushing 6), 16, 17, 18, 19 (for the bushing 7) and 20, 21, 22, 23 (for the bushing 8).

In accordance with the invention, making use of different thicknesses and eccentricities of the disks 12, 13, 14, 15 (on the bushing 6), 16, 17, 18, 19 (on the bushing 7) and 20, 21, 22, 23 (on the bushing 8), they are placed in such a position relative to the respective knives 9, 10, 11 that would allow balance to be attained in a horizontal position. The balance is fixed by the internal toothed surfaces 31, 32 of respective knives 9, 10, 11 and disks 12, 13, 14, 15, 16, 17, 18, 19, 20, 21, 22, 23 and the external toothed surfaces 30 of the bushings 6, 7, 8. Following this, each bushing 6, 7, 8 with the knives 9, 10, 11 and four disks 12, 13, 14, 15; 16, 17, 18, 19 and 20, 21, 22, 23 is fitted on the shaft 1 with the requisite angle of the edges 24, 25, 26 of the respective knives 9, 10, 11 in a manner whereat the bushing 6 and the knife 9 contact the support bushing 4. Thereupon, the washer 28 is properly fitted, and the nut 29 of the fixing member 27 is tightened to the preassigned effort.

Mincer operation necessitates periodic sharpening of the knives 9, 10, 11, which results in a wider clearance between the cutting edge 24, 25, 26 of the knives 9, 10, 11 respectively and the mincer body (omited in the drawing). This, in turn, affects the quality of the products being processed. To retain the requisite clearance, according to the invention, it is necessary to change the overhang of the cutting edge 24, 25, 26 of the knives 9, 10, 11 respectively. To this end, the fixing member 27 and the suitable bushing 6, 7, 8 carrying the knife 9, 10, 11 with the blunt cutting edge 24 is removed. The eccentricity of the bushing 6, 7, 8 makes it possible to extend the edge 24, 25, 26 of the knife 9, 10, 11 beyond the requisite size "R", after which the edge 24, 25, 26 is sharpened to the size "R". Following this, balancing and assembly are performed in a manner described hereinabove. Each subsequent sharpening is effected in the above manner, the beginning of replacement of the knife 9, 10, 11 is reckoned from the digit "0" on the bushing 6, 7, 8 by counter-clockwise movement of the reference point—the arrow " ↓ "—on the knife 9, 10, 11 towards the increase of the eccentiricity up to 180°.

A mincer knife head shown in FIGS. 6, 7, 8, 9, 10 is assembled in a manner similar to that described hereinabove, except that the two-step shape of the bushings 33, 34, 35 allows pair-wise installation of the knives 38 and 41, 39 and 42 and 40 and 43, which, accordingly, makes it possible to reduce the number of the eccentric disks 44, 45, 46, 47, 48, 49, 50, 51, 52 and thus to cut down metal consumption for the mincer knife head. The opposite eccentricities of the steps 36, 37 of each bushing 33, 34, 35 facilitate balancing. Besides, the double number of the knives 38, 39, 40, 41, 42, 43 cuts the time of processing the products and improves the quality thereof.

Figure 13:
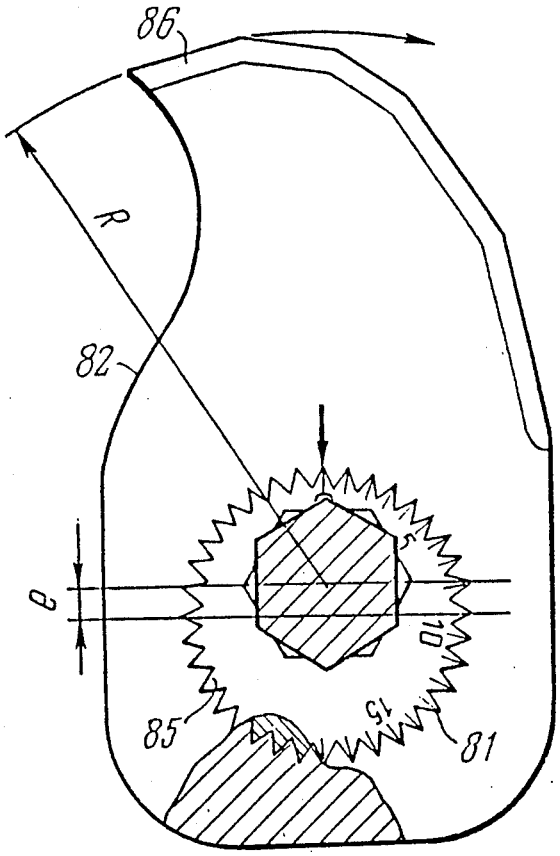
FIG. 13 is a cross-sectional view taken along line XIII—XIII in FIG. 11.

Assembly of a mincer knife head in accordance with FIGS. 11, 12, 13 is performed in a manner similar to that described with reference to FIGS. 1, 2, 3, 4, 5 except that balancing is done jointly by the main bushing 61, 62, 63 and the respective additional bushing 78, 79, 80.

The present invention allows multiple reconditioning of the knife edges, which extends the service life of the mincer knife head.

Besides, the present invention makes it possible to improve operational safety of the mincer knife head.

INDUSTRIAL APPLICABILITY

The present invention may be used to advantage in the meat and food industries.

What is claimed is:

1. A mincer knife head comprising a shaft (1) having an elongated axis, said shaft carrying, consecutively arranged thereon along said axis, a support bushing (4), a plurality of main bushings (6, 7, 8), and a fixing member (27), said main bushings being held in place between said support bushing and said fixing member, a least one knife (9, 10, 11) mounted on each of said main bushings, and at least one balancing disk (12 . . . 23) mounted one each on each of said main bushings, each of said balancing disks being eccentric with respect to the elongated axis of said shaft.

2. A knife head as in claim 1 wherein various ones of said disks have different thicknesses and different degrees of eccentricity from each other.

3. A knife head as in claim 1 wherein each of said main bushings is eccentric with respect to the elongated axis of said shaft.

4. A knife head as in claim 3 wherein each of said main bushings includes two adjacent portions (36, 37) along the elongated axis of said shaft, each of said portions being eccentric with respect to said axis with the eccentricity of each of said portions being in opposite directions, a knife (38, 39, 40) being mounted on one of said portions (36) of each of said main bushings, and a knife (41, 42, 43) and a balancing disk (44, 47, 50) being mounted on the other of said portions (37) of each of said main bushings.

5. A knife head as in claim 3 including at least one additional bushing (78, 79, 80) mounted on said shaft adjacent to each of said main bushings (61, 62, 63), and a knife (82, 83, 84) mounted on each of said additional bushings.

6. A knife head as in claim 5 wherein each of said additional bushings has an external surface which is serrated, and each knife mounted on each of said additional bushings has an internal surface which is serrated and which is in meshed engagement with the external surface of the additional bushing on which it is mounted.

7. A knife head as in claim 1 wherein each of said main bushings has an external surface which is serrated, and each of said knives and each of said balancing disks mounted on said main bushings has an internal surface which is serrated and which is is meshed engagement with the external surface of the main bushings on which said knives and balancing disks are mounted.

* * * * *